United States Patent [19]

DiMarco

[11] Patent Number: 4,972,394

[45] Date of Patent: Nov. 20, 1990

[54] MULTIPURPOSE EXTERNAL WATCH FACE ILLUMINATOR

[76] Inventor: Jon R. DiMarco, 3800 Fanwood Pl., Richmond, Va. 23233

[21] Appl. No.: 396,121

[22] Filed: Aug. 21, 1989

[51] Int. Cl.[5] ..... G04B 19/30

[52] U.S. Cl. ..... 368/227; 368/10; 368/67

[58] Field of Search ..... 368/227, 67

[56] References Cited

U.S. PATENT DOCUMENTS

| | | | |
|---|---|---|---|
| 1,441,069 | 1/1923 | Dandy | 368/227 |
| 3,018,614 | 1/1962 | Brien | 368/67 |
| 3,025,662 | 3/1962 | Fleishman et al. | 368/67 |
| 3,078,364 | 2/1963 | Neugebauer | 240/6.43 |
| 3,116,883 | 1/1964 | Neugebauer | 240/6.43 |
| 3,224,184 | 12/1965 | Brien | 368/67 |
| 3,508,044 | 4/1970 | Hochberg | 240/6.43 |
| 3,681,587 | 8/1972 | Brien | 368/67 |
| 4,417,819 | 11/1983 | Migeon | 368/227 |

FOREIGN PATENT DOCUMENTS

| | | | |
|---|---|---|---|
| 2263999 | 11/1973 | Fed. Rep. of Germany | 368/67 |
| 0025467 | 3/1978 | Japan | 368/227 |
| 343921 | 2/1960 | Switzerland | 368/67 |

*Primary Examiner*—Bernard Roskoski

[57] ABSTRACT

A watch face illuminating device packaged inside a watchband and totally independent of any watch employs a bright and narrow beam of light to illuminate any type of watch by means of reflection of said beam from any reflective surface such as a finger or article of clothing. Electrical circuit means for connecting a battery power source to the light emitter contains a push-button switch and a timer for extinguishing the light source after a preset time period and a light emitter current regulator for more constant light emitter output to counter the effects of continuously decreasing voltage over the life of the battery. The device may also be employed in the manner of a small flashlight for illuminating tasks and objects close at hand.

1 Claim, 3 Drawing Sheets

MULTIPURPOSE EXTERNAL WATCH FACE ILLUMINATOR

FIELD OF INVENTION

This invention relates to watch face illuminators and specifically to an illumination means external to any watch employing a bright and narrow beam of light directed away from the watch face and which also can be used in the manner of a flashlight.

DISCUSSION OF PRIOR ART

Prior means for externally illuminating watch faces has required lifting a light source over the watch face or pushing an illuminating slide over the watch face with both means involving mechanical complexity and increased possibility of breakage due to sudden movements of the wrist or getting caught in shirt or jacket cuffs. Still others employ slide-switch type on-off switches which are unsightly, prone to mechanical wear and introduce the possibility of leaving the light source on through operator forgetfulness until the battery is drained. Furthermore, all of the above methods insure that the styling of the watch and band combination is degraded.

Heretofore, the light source employed by either internal or external illuminating methods has been from an incandescent filament which eventually involves costly and time consuming replacement by a jeweler.

OBJECTS

It is a primary object of this invention to provide a watch face illuminating means which is easily operated.

Another object of the present invention is to provide a means whereby the user may illuminate the watch face and still have use of all fingers to access all watch functions.

Another object of the present invention is to provide a means whereby the user may use the highly focused light source in the manner of a small flashlight.

Another object of the present invention is to provide an illumination means which is electrically and mechanically reliable over long periods of time and in the environmental extremes of temperature, humidity, particulate matter and organic matter.

Still another object of this invention is to produce a device which the user can replace batteries without the help and expense of a jeweler.

Still another object of this invention is to produce an electrical regulator circuit which maintains light output to be as constant as possible over the life of the battery.

Still another object of this invention is to provide a means whereby the light source will extinguish itself after a set time interval and further have the means to allow the user to continually extend the time interval.

Further objects and advantages of my invention will become apparent from a consideration of the drawings and ensuing description thereof:

DRAWINGS

DESCRIPTION

Figure 1:
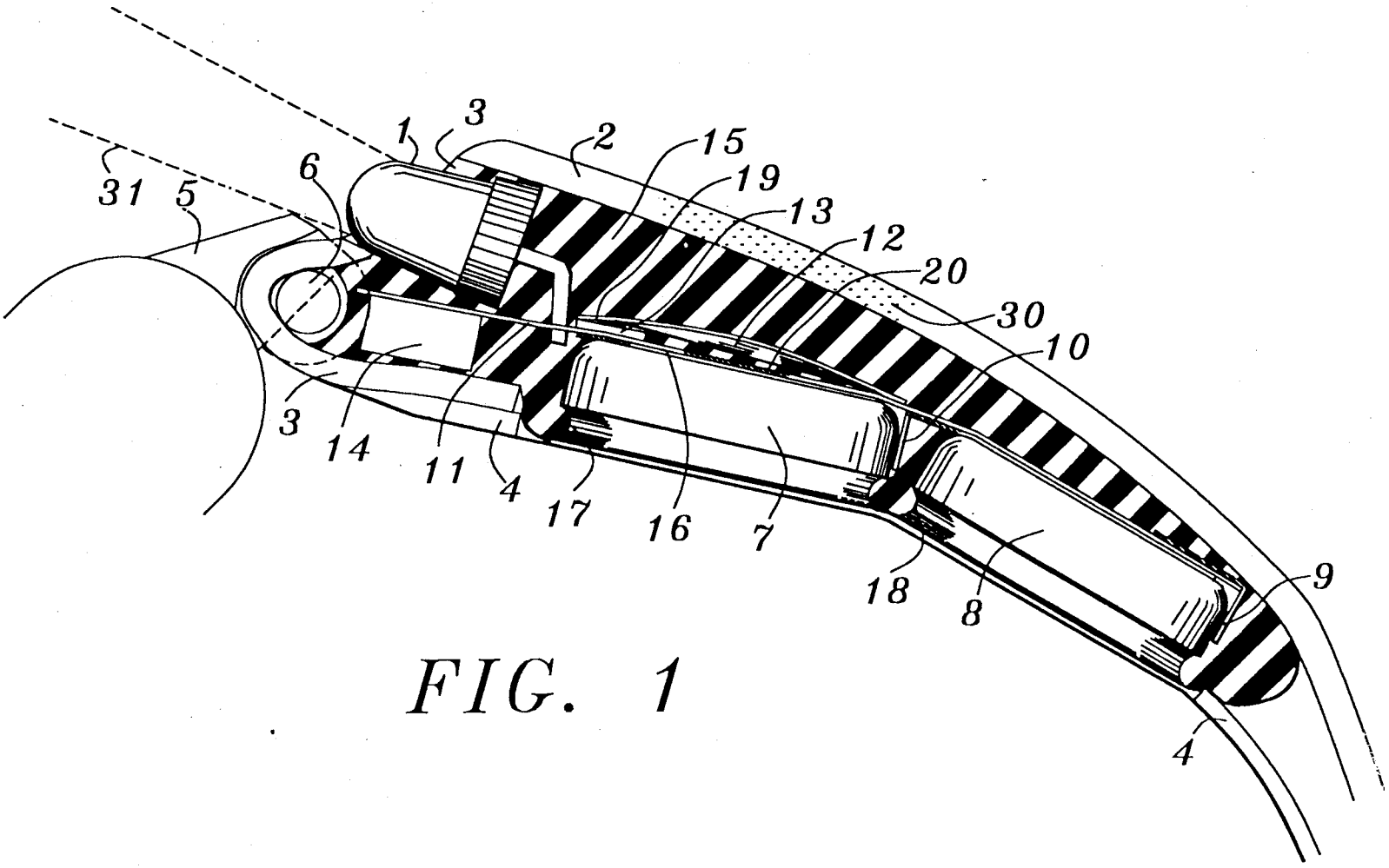
FIG. 1 is a cross-sectional view of the battery, switch, electronics and light emitter.

As shown in FIG. 1, printed wiring board 11 mounts all of the working components of hte invention by means of standard mass production soldering techniques.

Light emitter 1 is an ultra-bright light emitting diode and integral optically clear lens with a typical brightness of 150 milli-candelas @20 milliamperes and a focused, half-power beam width of 10 degress. The color of the emitted light is optimally green (typical wavelength 565 nanometers) or secondarily yellow (585 nm) since these are the colors, respectively, for which the human eye is most sensitive. Light emitter 1 is mounted so that it will direct it's focused beam of light just over any obstruction of typical watch 5.

Timer/current-regulator 14 (also shown in FIG. 3 in dotted outline) allows a regulated amount of current to pass through light emitter 1 from batteries 7 and 8 for a finite amount of time when a voltage pulse is received from snap-dome switch 12.

Batteries 7 and 8 silver oxide "button cells" with a closed circuit voltage of 1.3 Volts and typical capacity of 39 milliamperehours.

Battery contacts 9,10 and 16 are each composed of a 6 mm wide strip of beryllium copper.

Battery contact 16 is soldered at its left-hand end to printed wiring board 11 as depicted by hatched lines such that its middle and right-hand end are free to apply a spring force to contact the negative terminal of battery 7.

Battery contact 10 is soldered to printed wiring board 11 as depicted by hatched lines such that its left-hand end will apply a spring force to the positive terminal of battery 7 and its right-hand end will apply a spring force to the negative terminal of battery 8.

Similarly, battery contact 9 is soldered to printed wiring board 11 as depicted by the hatched lines so that its right-hand end may apply a spring force to the positive terminal of battery 8.

Snap-dome switch 12 is normally open. The right-hand edge of snap-dome switch 12 rests on a printed wiring land which connects with battery contact 9. The left-hand edge of snap-dome switch 12 rests on insulating spacer 13 thereby maintaining an open circuit from switch contact point 20 and its connecting printed wiring foil. Adhesive tape 19 is typically a 0.025 mm thick polyester tape which serves to hold snap-dome switch 12 and insulating spacer 13 in place.

Figure 2:
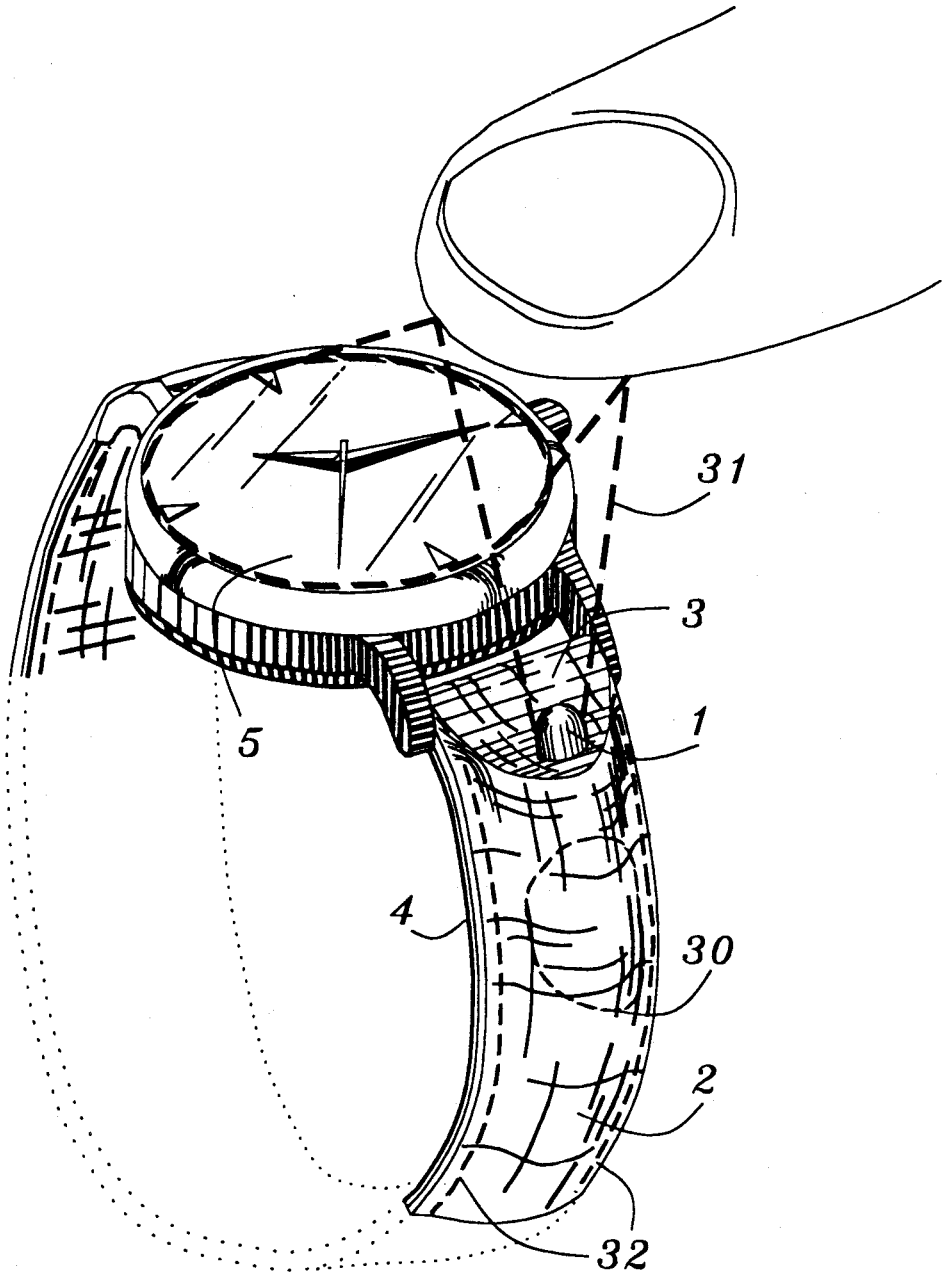
FIG. 2 is prespective view of the watch face illuminator showing the principle of light reflection from a finger.

In the preferred embodiment, outer layers 2,3 and 4 are leather skins. Outer layers 2 and 3 are each about 0.9 mm thick and outer layer 4 is about 0.4 mm thick. As can be seen in FIG. 2, outer layers 2 and 4 are joined by stitching 32. A leather glue may also be applied to further strengthen the lamination of outer layers 2 and 4 as is typical in standard leather watchband construction.

Referring to FIG. 1, printed wiring board 11 and all of its attached components is potted inside the watchband with a silicone rubber adhesive 15. During potting, two cylindrical voids are formed for batteries 7 and 8 which have lips 17 and 18 of slightly smaller diameter than the battery cases and which serve to hold tdhe batteries in place and to seal all terminal contact points from moisture.

The entire assembly as mentioned above is attached to a typical watch 5 by means of typical metal spring bar 6.

DESCRIPTION AND OPERATION OF THE TIMER/CURRENT-REGULATOR

Figure 3:
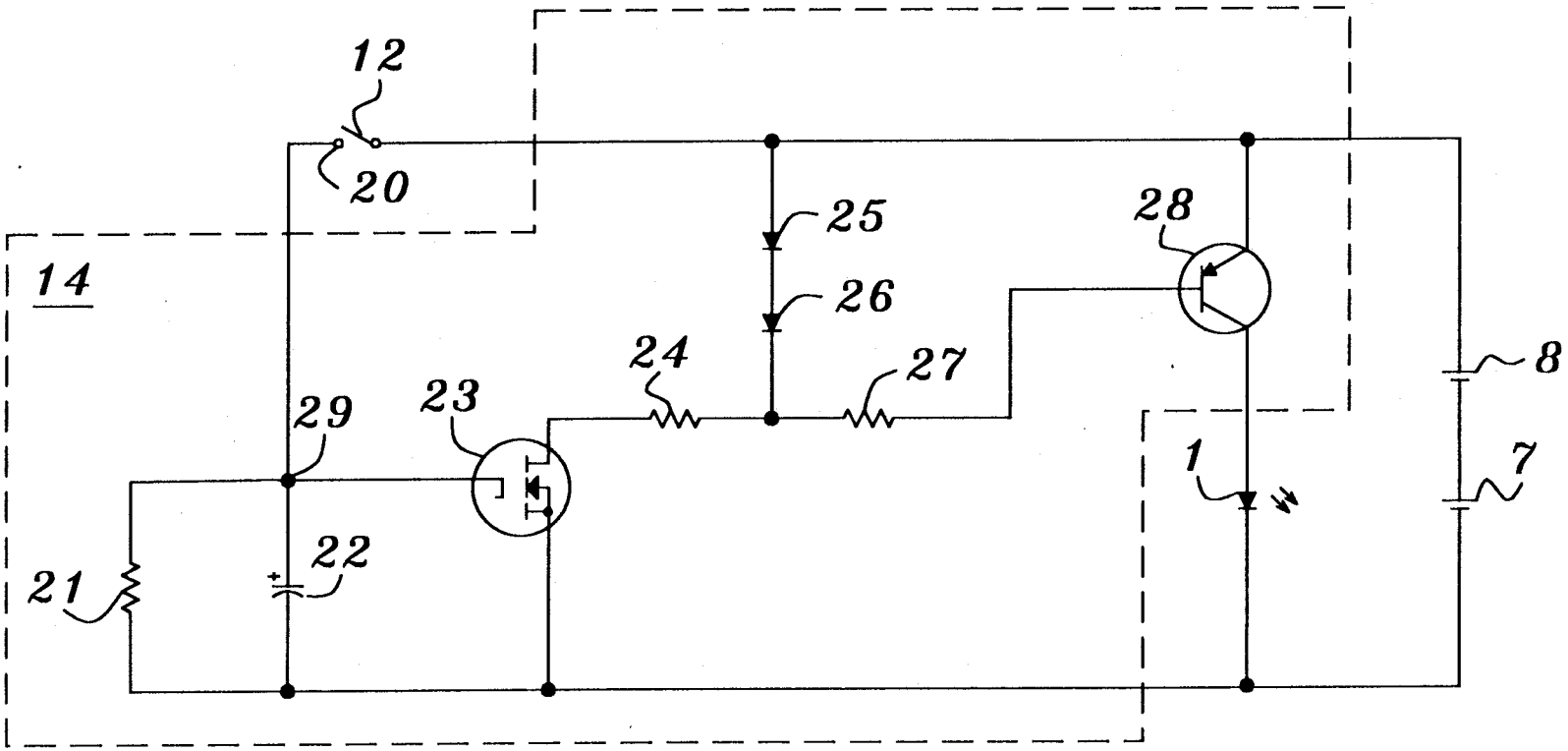
FIG. 3 is a schematic diagram of the switch/timer/-current-regulator.

With the circuit of FIG. 3 in its quiescent state essentially no battery current is being drawn except for extremely small leakage currents which are of no consequence in terms of shortening the life of the batteries.

When snap-dome switch 12 closes the combined positive voltage of batteries 7 and 8 appears at node 29. MOSFET 23 immediately changes from extremely low conductance to very high conductance. When snap-dome switch 12 opens, the voltage at node 29 will begin to decay according to the time-constant values of resistor 21 and capacitor 22. MOSFET 23 will remain in high conductance until the voltage at node 29 decays past its threshold point.

With MOSFET 23 in high conductance a current now flows through the emitter-base junction of transistor 28 causing it to operate in saturation. Current is now sent to light emitter 1 in proportion to the current passing through the emitter-base junction of transistor 28. Light emitter 1 now emits light with an intensity that is in proportion to the current passing through it.

Resistors 24 and 27 serve to limit the current passing through emitter-base junction of transistor 28 and silicon diodes 25 and 26 act to stabilize this current to a value that is much less dependent on the voltage from batteries 7 and 8. Thus, the brightness of light emitter 1 is maintained at a steady level which is independent of the useful state of charge of the batteries.

OPERATION OF THE INVENTION

To operate the invention to illuminate a watch face the user presses and releases the area 30 of outer layer 2 that is directly above snap-dome switch 12 as can be seen in FIG. 1. This causes light emitter 1 to illuminate to full brightness immediately. Light emitter 1 will remain illuminated for any number of seconds as determined by the time constant of resistor 21 and capacitor 22 of FIG. 3. In the preferred embodiment eight seconds was chosen as a suitable on-time for light emitter 1.

Referring to FIG. 2, to actually cast light upon the watch face the user would typically place a part of his hand in the light beam 31 emitted from light emitter 1 in such a manner as to reflect the light onto the watch face.

If the user is illuminating a digital watch face and desires to set the time, alarm or access any other function that such a watch may have, he may do so by using the area of his palm between his thumb and index finger to reflect light beam 31 onto the watch face. In this way his fingers will be free to operate the necessary buttons.

When the said on-time of light emitter 1 has expired the light intensity will begin to decrease to darkness over a period of about four seconds. The said on-time is thus defined as that time period beginning when the user releases pressure on area 30 to the time when the light intensity of light begins to decrease.

In the preferred embodiment, if the user wishes to extend the said on-time while light emitter 1 is emitting light he may do so by pressing and releasing area 30. In this way he can extend the said on-time any number of times in said eight second increments.

As can be seen in FIG. 1, light beam 31 is directed entirely away from the watch 5. This feature enables the invention to be used to illuminate other objects other than watch faces. For example, keyholes may be illuminated with the invention while leaving the other hand free to manipulate the key into the lock.

Another example would be to be able to find a light switch or find one's way in a darkened room.

Still another example would be to provide emergency lighting to perform such tasks as working on an automobile engine on a dark road.

Still another example would be to provide discrete lighting for reading menus in dimly lit restaurants or theater programs after the house lights have dimmed down.

While the above description contains many specificities, these should not be construed as limitations on the scope of the invention, but rather as an exemplification of one preferred embodiment thereof. Many other variations are possible, for example:

Outer layer 2,3 and 4 may be constructed of many types of flexible plastic or the skins of other animals or reptiles as suits the watchband designer.

Outer layer 2,3 and 4 may also be constructed of metal. In which case the outline of area 30 would delineate the edges of a separate metal plate. Such plate would allow actuation of snap-dome switch 12.

The emitted color of light from light emitter 1 may be any color as suits the design and intent of the application of the invention.

Accordingly, the scope of the invention should be determined not by the embodiment illustrated, but by the appended claims and their legal equivalents.

What is claimed is:

1. An illuminating device incorporated within a watchband at an extremity thereof adjacent an attached wristwatch, said device comprising:

(a) a light emitting diode and integral focusing lens, said focusing lens directing said light at a beam angle of about 10 degrees in a direction generally above said wristwatch, such that the light from the diode only contacts the watch face through reflection;

(b) battery means and associated conductor means forming an electric circuit for conveying current to said diode;

(c) resilient switch means associated with said conductor and adapted to complete said electrical circuit to activate said diode, said switch being concealed within said watchband and displaceable from its off position to its on position by pressure applied upon said watchband, said switch restoring itself to its off position when said pressure is released;

(d) and electrical timing means associated with said electrical circuit for turning off said diode after a set duration.

* * * * *